US005501332A

United States Patent [19]

Ayres et al.

[11] Patent Number: 5,501,332

[45] Date of Patent: *Mar. 26, 1996

[54] CIGARETTE EXTINGUISHING STORAGE DEVICE

[75] Inventors: George E. Ayres, Campbellville; Gary D. Black, Brampton; Larry Bowen, Orangeville, all of Canada; Warren A. Brackmann, Collins, Mo.; Benedict Keaveney, Rexdale; John D. Kilpatrick, Aurora, both of Canada

[73] Assignee: Rothmans, Benson & Hedges, Inc., North York, Canada

[ * ] Notice: The term of this patent shall not extend beyond the expiration date of Pat. No. 5,377,826.

[21] Appl. No.: 281,279

[22] Filed: Jul. 27, 1994

Related U.S. Application Data

[63] Continuation of Ser. No. 8,347, Jan. 22, 1993, Pat. No. 5,377,826.

[51] Int. Cl.[6] ..... A24F 13/18

[52] U.S. Cl. ..... 206/246; 131/235.1; 131/256

[58] Field of Search ..... 206/242, 246; 131/256, 235.1, 237, 237.5

[56] References Cited

U.S. PATENT DOCUMENTS

| | | | |
|---|---|---|---|
| 1,172,411 | 2/1916 | Von Kaenel | 206/246 |
| 1,459,077 | 6/1923 | Winans . | |
| 1,598,112 | 8/1926 | Bauda . | |
| 2,246,642 | 6/1941 | Stachowiak | 206/41 |
| 2,335,674 | 11/1943 | Horlick | 206/41 |
| 2,536,302 | 1/1951 | Martzel | 131/256 |
| 2,715,961 | 8/1955 | Field | 206/38 |
| 2,781,762 | 2/1957 | Mears | 131/256 |
| 3,107,674 | 10/1963 | Smith | 131/256 |
| 3,978,981 | 9/1976 | Musick | 206/276 |
| 4,052,179 | 10/1977 | Kink | 131/235.1 |
| 4,231,379 | 11/1980 | Kohori | 131/235.1 |
| 4,548,217 | 10/1985 | Saculla | 131/256 |
| 4,587,980 | 5/1986 | Tipper | 131/235.1 |
| 4,660,575 | 4/1987 | Andreason et al. | 131/256 |
| 4,777,968 | 10/1988 | Beloff | 131/256 |
| 4,809,715 | 3/1989 | Musetti | 131/256 |
| 4,886,076 | 12/1989 | Gilbert et al. | 131/256 |
| 5,002,073 | 3/1991 | Chaing | 131/235.1 |

*Primary Examiner*—David T. Fidei
*Attorney, Agent, or Firm*—Sim & McBurney

[57] ABSTRACT

A cigarette extinguishing and storage device is of tubular shape and provided by telescoping elements which define an enclosure in which a lit cigarette is received to extinguish the same and in which the extinguished cigarette is stored until the smoker wishes to relight the same. Charcoal or other suitable deodorant means is provided at the internal surface of the enclosure to absorb condensates from tobacco smoke. The device preferably is made of one or more plies of paper, so as to be disposable.

14 Claims, 1 Drawing Sheet

CIGARETTE EXTINGUISHING STORAGE DEVICE

This is a continuation of application Ser. No. 008,347 filed Jan. 22, 1993 now Pat. No. 5,377,826.

FIELD OF INVENTION

The present invention relates to a device for extinguishing a partially-smoked lit cigarette and for storing the extinguished cigarette until the smoker wishes to relight the cigarette for further smoking.

BACKGROUND TO THE INVENTION

Smokers often are required or choose to extinguish a partially-smoked cigarette and the partially-smoked cigarette then is stored for further smoking at a later time. A variety of devices has been proposed which will function both as an extinguisher for the cigarette and as a storage means for the extinguished cigarette.

In particular, the applicants are aware of the following U.S. Pat. Nos.

1,459,077, 1,598,112, 2,246,642, 2,335,674, 2,536,302, 2,715,961, 2,781,762, 3,107,674, 3,978,981, 4,587,980, 4,660,575, 4,777,968, 4,809,715, and 4,886, 076.

The cited prior art describes a variety of devices in the form of a housing which is intended to be permanent in nature and in which the cigarette is extinguished and then stored.

One problem faced by a smoker extinguishing a cigarette and then subsequently relighting the cigarette for further smoking is that a burnt tobacco taste and/or odour may be detected by the smoker as a result of contamination of the cigarette by gaseous or solid contaminants when the cigarette was extinguished. To attempt to combat the worst aspects of this effect, the prior art has provided cutting devices to remove the extinguished coal and expose fresh tobacco for relighting the cigarette. For example, in the above-cited prior art, U.S. Pat. Nos. 1,459,077 and 3,107, 674 teach built-in cutting devices.

SUMMARY OF INVENTION

In accordance with one aspect of the present invention, there is provided a novel form of cigarette extinguishing and storage device comprising first and second telescoping tubular elements which cooperate to provide an enclosure for extinguishing cigarette and for storing an extinguished cigarette. The telescoping elements are dimensioned to receive a cigarette sliding fit relationship therewith.

The sliding fit relationship between the cigarette and the telescoping elements ensures a rapid extinguishing of a lit cigarette when the burning end of the cigarette is inserted into the telescoping element receiving the same, since the tubular element is rapidly starved of oxygen required to maintain the coal lit.

Deodorant means is located in the enclosure formed by the telescoping elements for minimizing the adverse effects of cigarette smoke condensates in the enclosure.

Once a lit cigarette has been inserted into the telescoping element receiving the same and the cigarette is extinguished, the other telescoping element is slid into telescoping relationship with the other element to enclose completely the extinguished cigarette for storage.

In this way, once the extinguished coal of a cigarette extinguished and stored in the device is removed from the cigarette to expose fresh tobacco and the cigarette is relit, the smoker experiences a reduction in the adverse effects of having extinguished the cigarette.

The deodorant means generally serves to absorb the condensates as they are formed in the enclosure during extinguishing of the cigarette, preventing contamination of the cigarette thereby.

However, some of these condensates deposit on the tobacco and cigarette paper-in the extinguishing device and these deposited condensates slowly volatilize while the cigarette is located in the extinguishing device. These volatilized materials also are absorbed by the deodorant means from the gas in the snuffer and prevent contamination of the cigarette in the extinguishing device and the various surfaces present.

Another aspect of the present invention provides a disposable tubular cigarette extinguishing and storage device which is structurally self-supporting and is constructed of one or more plies of paper, which may be of variable thickness. Such disposable device comprises a first tubular element closed at one end and open at the other, a second tubular element closed at one end and open at the other and having the same diameter as the first tubular element, whereby the open ends of the first and second tubular elements abut to define an enclosure, and a third tubular element mounted in fixed relation to the first tubular element, having an inside diameter such as to receive a lit cigarette in sliding-fit relationship thereto, and extending from the open end of the first tubular element into sliding-fit relationship with the second tubular element, whereby the enclosure is opened and closed by relative telescoping movement of said second and third tubular elements.

As noted earlier, the prior art extinguishing and storage devices are not intended to be disposable. The provision of a disposable device of inexpensive construction permits use for a few cigarettes and then disposal in the form of an environmentally acceptable material. The prior art permanent devices are expensive to manufacture and require maintenance to avoid significant contamination.

DESCRIPTION OF PREFERRED EMBODIMENTS

Figure 1:
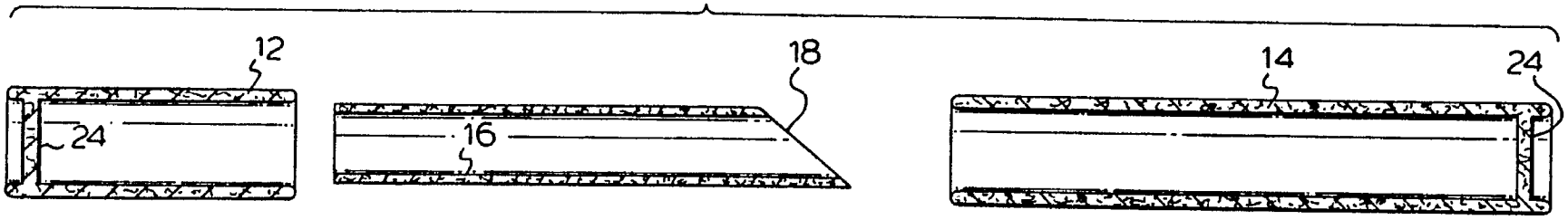
FIG. 1 is an exploded sectional view of the elements of a tubular Cigarette extinguishing and storage device provided in accordance with one-embodiment of the invention.

Referring to the drawings, a structurally self-supporting tubular cigarette extinguishing and storage device 10, preferably constructed of one or more plies of paper which may be of various thicknesses, so as to be disposable, comprises three interacting tubular elements 12, 14 and 16.

Elements 12 and 14 are closed at one end and open at the other and have the same inner and outer diameters. Element 16 is mounted in fixed relation to element 12 and extends therefrom into sliding fit relationship with tubular element 14, so that the open ends of the tubular elements 12 and 14 abut one another when the device is closed.

In the illustrated embodiment, the tubular element 12 comprises approximately one third and the tubular element 14 comprises approximately two-thirds of the overall length of the device 10, although variations in these relative dimensions are possible.

Figure 2:
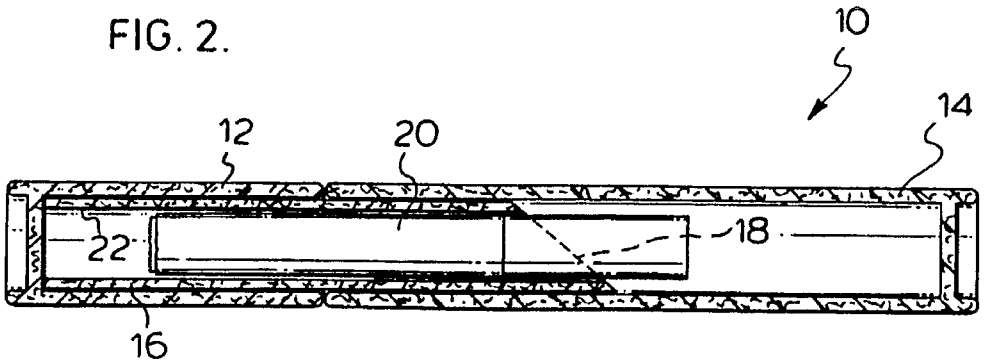
FIG. 2 is an assembled sectional view of a tubular cigarette extinguishing and storage device assembled from the elements of FIG. 1.

As seen in side elevation, tubular element 16 is provided with an angular cut 18 at its open end. This angular cut 18 provides a convenient lead-in for a lit cigarette into the tubular element 16. The tubular element 16 has an inside diameter such as to receive a cigarette 20 in sliding fit relation thereto, as seen in FIG. 2.

The sliding fit relationship of the cigarette 20 and the tubular element 16 ensures that a lit cigarette is rapidly extinguished when inserted into the tubular element 16, as a result of rapid depletion of oxygen necessary to maintain the cigarette in a lit condition.

In addition, the angular cut 18 acts as an indicator to the user of the device as to the half of the device 10 into which the lit cigarette is intended to be placed. Visual indicia also may be employed to assist the smoker in this regard. Further, the angular cut 18 facilitates removal of an extinguished cigarette from the tubular element 16, particularly if the butt of the cigarette is sufficiently small that the cigarette 20 has been inserted deeply into the tubular element 16.

The inner surface of the tubular element 16 and also possibly the tubular element 14 have a deodorant means therein to absorb condensates contained in tobacco smoke and in the burning coal of the cigarette 20 when inserted into the tubular element 16, thereby minimizing the adverse effect of such materials.

The deodorizing material also functions to absorb volatile materials released from the cigarette after being extinguished and while being stored in the device 10.

The deodorizing material may take the form of sheet material, which may replace one or more inner layers of paper used for construction of the tubular elements 14 and 16.

One substance-which may be used as the deodorant is charcoal. When employed, the charcoal may be provided by impregnation into the surface of the material from which the respective tubular element is formed or may be provided as a coating on the inner surface.

The charcoal preferably is of such a concentration as to achieve the desired deodorizing action but not sufficient to smudge or otherwise adversely affect the appearance of the cigarette 20 received in the tubular element 16.

Charcoal is an effective deodorant material and has the advantage of being colored, so that the smoker is aware of its presence, and particulate, so that it is readily distributed in the enclosure. However, any other material which functions as a deodorant by absorption of tobacco smoke condensates may be used, such as particulate sodium bicarbonate (baking soda), aluminum oxide or silica gel.

The deodorant is provided in the illustrated device distributed in the inner walls of the device. This manner of provision of the deodorant in the enclosure provides a large surface area for absorption of the condensates and hence an efficient means of providing the deodorizing action. However, any other desired manner of provision of the deodorant may be employed.

In use, when it is desired to extinguish a partially-smoked cigarette for later further smoking, the tubular element 14 is withdrawn from its telescoped relation to the tubular element 16, thereby opening the device 10 for receipt of the lit cigarette 20. The lit cigarette 20 is inserted in sliding fit relation to the tubular element 16, as seen in FIG. 2. Since the lit coal is immediately starved of oxygen, it goes out and condensates which otherwise may contaminate the cigarette are absorbed by the charcoal 22.

The tubular element 14 then is slid over the tubular element 16 into abutting relationship with the tubular element 12 to enclose the cigarette 20 in the device 10 for storage therein until the smoker is ready to smoke the cigarette again.

The device 10 may be stored in any convenient manner. The device 10 usually has a length which is approximately that of a cigarette, so that the device 10 may be stored with unsmoked cigarettes in a cigarette package. The enclosed nature of the device 10 serves to segregate the unsmoked cigarettes in the package from the partially-smoked cigarette contained in the device 10 and to shield the unsmoked cigarettes from any potential adverse effect of the partially-smoked cigarette.

When the smoker desires to complete smoking of the cigarette, the device 10 is reopened and the cigarette 20 withdrawn. The extinguished coal may be removed from the end of the cigarette by a suitable cutting device to expose fresh tobacco for relighting.

The tubular cigarette extinguishing and storage device 10 is particularly useful with a cigarette having a greater-than-normal number of puffs, specifically designed to be smoked for part of the length of the cigarette, extinguished, stored and subsequently relit, as described in copending U.S. patent applications Ser. Nos. 968,590 and 968,591, filed Oct. 29, 1992, assigned to the assignee hereof and the disclosures of which are incorporated herein by reference.

As an alternative to the illustrated structure described above, elements 12 and 16 may be replaced by a single element wherein the open end is compressed in such a way that the outside diameter of the compressed portion of the element corresponds to the inside diameter of the second part, so that a friction lock is achieved between the slightly tapering swagged end of the single element.

When the latter arrangement is employed, the swagged end of the element is provided with an inside diameter which permits a lit cigarette to be received in sliding fit therewith. In additional, an angular cut analogous to cut 18 may be employed at the swagged end.

In addition, the elements 12 and 16 may be replaced by a single element having a diameter sufficient to receive the element 14 in sliding fit relationship thereto.

As seen in FIGS. 1 and 2, the elements 12 and 14 have end closures provided by discs 24 received and inserted into open ends of the elements 12 and 14. Alternatively, the side wall of the elements 12 and 14 may be collapsed inwardly and crushed at the open end to achieve the closure and present the appearance of a solid closed end. Any other technique to effect the end closure may be adopted.

SUMMARY OF DISCLOSURE

In summary of this disclosure, the present invention provides a novel tubular cigarette extinguishing and storage device which is disposable and is able to overcome the adverse effects of tobacco smoke condensates upon extinguishing the cigarette within the device. Modifications are possible within the scope of this invention.

What we claim is:

1. A tubular cigarette extinguishing and storage device, comprising:

a first individual tubular element comprising a tubular wall closed at one end and open at another end and having an outer surface and an inner surface and having a diameter defining a single cigarette-receiving tubular cavity, a second individual tubular element comprising a tubular wall closed at one end and open at another end and having an outer surface and an inner surface and having a diameter defining a single cigarette-receiving tubular cavity, said first and second individual tubular elements being constructed to permit an overlapping sliding fit relationship between portions of said first and second tubular elements adjacent, their open ends to define an enclosure for extinguishing a single cigarette and for storing an extinguished single cigarette, said first and second individual tubular elements being dimensioned to receive a single cigarette in sliding fit relationship with an internal surface of overlapping portions of said first and second individual tubular elements and deodorant means located in said enclosure for minimizing the adverse effects of cigarette smoke condensates in said enclosure, said deodorant means being provided by particulate material provided in the form of a layer formed at the inner surface of at least the one of said individual tubular elements into which a single lit cigarette is intended to be received for extinguishing the same.

2. The device of claim 1 wherein said particulate deodorant material is provided in the form of a layer formed at the inner surface of at least one of said individual tubular elements.

3. The device of claim 1 wherein said particulate deodorant material comprises charcoal.

4. The device of claim 1 wherein said particulate deodorant material is selected from the group consisting of sodium bicarbonate, aluminum oxide and silica gel.

5. The device of claim 1 wherein said first and second individual tubular elements are provided by a first tubular element having an inner diameter which is substantially constant along its length and a second tubular element, with the open end swagged to an outer diameter corresponding to the inner diameter of said first tubular element and tapering slightly toward the open end thereof, whereby said first and second tubular elements telescope together into a friction-fit relationship.

6. The device of claim 5 wherein said second tubular element has an inner diameter sufficient to permit a lit cigarette to be received in the sliding fit relationship therewith.

7. The device of claim 1 wherein said first and second tubular elements are provided by:

a first tubular element closed at one end and open at the other and having an inner and an outer diameter, a second tubular element having the same inner and outer diameter as that of said first tubular element whereby the open ends of said first and second tubular elements abut to define an enclosure, and a third tubular element mounted in fixed relation to said first tubular element and extending from the open end of said first tubular element sliding fit relationship with said second tubular element, whereby said enclosure is opened and closed by relative movement of said second and third tubular elements.

8. The device of claim 7 wherein said third tubular element has an inside diameter sufficient to permit a lit cigarette to be received in sliding fit relationship thereto.

9. A disposable tubular cigarette extinguishing and storage device which is structurally self-supporting and constructed of at least one ply of paper, comprising:

a first individual tubular element comprising a tubular wall closed at one end and open at the other and having an inner and an outer diameter defining a single cigarette-receiving tubular cavity, a second individual tubular element comprising a tubular wall closed at one end and open at the other end and having the same inner and outer diameters as that of said first tubular element whereby the open ends of said first and second tubular elements abut to define a single cigarette-receiving tubular enclosure, and a third tubular element comprising a tubular will mounted in fixed relation to said first tubular element, having an inside diameter such as to receive a single lit cigarette in sliding fit relation thereto, and extending from the open end of said first tubular element into sliding fit relationship with said second tubular element, whereby said enclosure is opened and closed by relative movement of said second and third tubular elements.

10. The device of claim 9, wherein at least one of said second and third tubular elements has particulate deodorant material at an interior surface of the respective tubular wall thereof.

11. The device of claim 10, wherein said particulate deodorant material is charcoal of a concentration at least sufficient to absorb condensable cigarette smoke components when a lit cigarette is positioned in the device and yet is not of sufficient density as to smudge or otherwise adversely affect the appearance of the cigarette.

12. The device of claim 11 wherein said third tubular element has an open end for receipt of a lit cigarette therein which has an angular cut when viewed is side elevation.

13. The device of claim 12 wherein said first tubular element comprises about one-third of the length of said device and said second tubular element comprises about two-thirds of the length of said device.

14. The device of claim 12 wherein said first and second tubular elements are dimensioned to fully enclose a cigarette when said open ends are in abutment.

* * * * *